US006389695B1

(12) United States Patent
Dall'Oro et al.

(10) Patent No.: US 6,389,695 B1
(45) Date of Patent: May 21, 2002

(54) SERPENTINE HEAT EXCHANGER

(75) Inventors: Roberto Dall'Oro; Pier Luigi Picco, both of Pieve Ligure; Remo Prato, Genoa, all of (IT)

(73) Assignee: Bundy International Limited, Oxfordshire (GB)

( * ) Notice: Subject to any disclaimer, the term of this patent is extended or adjusted under 35 U.S.C. 154(b) by 0 days.

(21) Appl. No.: 09/068,526

(22) PCT Filed: Nov. 13, 1996

(86) PCT No.: PCT/GB96/02769

§ 371 Date: Jun. 26, 1998

§ 102(e) Date: Jun. 26, 1998

(87) PCT Pub. No.: WO97/18428

PCT Pub. Date: May 22, 1997

(30) Foreign Application Priority Data

Nov. 13, 1995 (IL) ..... SV95A0026

(51) Int. Cl.[7] ..... F28F 1/32
(52) U.S. Cl. ..... 29/890.03; 62/507; 165/171
(58) Field of Search ..... 165/150, 171; 62/507; 29/890.03

(56) References Cited

U.S. PATENT DOCUMENTS

| | | | | |
|---|---|---|---|---|
| 1,773,249 A | | 8/1930 | Yeager | |
| 2,705,877 A | * | 4/1955 | King | 165/171 X |
| 2,706,105 A | * | 4/1955 | Young | 165/171 X |
| 2,908,070 A | * | 10/1959 | Thomas et al. | 165/171 X |
| 3,460,225 A | * | 8/1969 | Beauvais | 29/890.07 |
| 3,827,483 A | | 8/1974 | Hopkinson | 165/145 |
| 5,117,523 A | * | 6/1992 | Jacobus et al. | 62/259.1 |
| 5,428,973 A | | 7/1995 | Temmyo et al. | 62/452 |

FOREIGN PATENT DOCUMENTS

| | | |
|---|---|---|
| DE | 85 31 335 | 12/1985 |
| FR | 965464 | 9/1950 |
| FR | 2189693 | 1/1974 |
| GB | 736155 | 9/1955 |
| GB | 1006039 | 9/1965 |
| GB | 2286882 | 8/1995 |

* cited by examiner

*Primary Examiner*—Allen Flanigan
(74) *Attorney, Agent, or Firm*—Jenner & Block

(57) ABSTRACT

A method for building a serpentine heat exchanger, particularly a condenser for refrigerating circuits being profiled in such a way to present from a lateral side view and relative to at least one part of its length an inclination the direction of which is suddenly or progressively inverted at least once relative to a plane which is substantially parallel to one of the directions defined by the extension of the exchanger (3), in particular relative to a plane substantially parallel to the principal direction of a flow of air in which the exchanger (3) is located, and in special manner relative to a substantially vertical or substantially horizontal plane. According to the invention, the method comprises the following steps: a) the construction at least of the serpentine or of the complete exchanger in a flat configuration; b) the bending and/or moulding, or deforming of the flat serpentine or of the flat complete exchanger in a way to assume the desired inclinations.

4 Claims, 5 Drawing Sheets

SERPENTINE HEAT EXCHANGER

Method for building a serpentine heat exchanger particularly a condenser for refrigerating circuits and serpentine heat exchanger according to the said method.

The invention refers to a method for building a serpentine heat exchanger, particularly a condenser for refrigerating circuits being profiled in such a way to present from a lateral side view and relative to at least one part of its length an inclination the direction of which is suddenly or progressively inverted at least once relative to a plane which is substantially parallel to the general plane of the heat exchanger, in particular relative to a plane substantially parallel to the principal direction of a flow of air in which the exchanger is located, relative to a substantially vertical or substantially horizontal plane.

Such kinds of exchangers or condensers are known and normally they show an undulated or a "zigzag" profile. One such heat exchanger is disclosed in GB 736155 and comprises a pipe bent into a serpentine configuration consisting of a series of substantially parallel straight pipe sections, a plurality of wires attached to each side of the serpentine configuration, the wires extending along the length of the serpentine configuration and being attached to the straight pipe sections thereof, the heat exchanger being bent at two places along its length in order to provide an undulated or zigzag profile.

From the functional point of view this kind of exchanger ensures a great improvement of the thermal exchange. Such kind of exchanger make it possible to increase the surface for thermal exchange or to increase the length of the serpentine, while maintaining their overall dimensions between certain limits.

Furthermore, the particular non-flat profile of the exchanger causes turbulences in the air flow along the exchanger thus increasing the efficiency of the thermal exchange.

On the other hand however, the manufacture of the said undulated or zigzag exchangers is not as simple as for the usual plane exchangers and the production lines for building the usual plane exchangers cannot be used to build undulated or zigzag profiled exchangers without any alteration for adaptation to the new product. Thus for the production of undulated or zigzag exchangers special lines are needed so that the costs of production rise compared to the production of usual plane exchangers.

An object of the present invention is to create a method for building a heat exchanger of the kind mentioned above, with which it is possible to avoid the aforementioned disadvantage and which ensures a low cost production of undulated and/or zigzag profiled exchangers of better quality.

The present invention achieves the before mentioned aim with a method for building exchangers of the kind mentioned at the beginning, which method is characterised by the steps of bending a pipe into a flat serpentine configuration consisting of a series of substantially parallel straight pipe sections, attaching a plurality of wires to each side of the flat serpentine configuration, said wires extending along the length of the flat serpentine configuration and being attached to said straight pipe sections thereof, and bending the flat serpentine configuration and the wires attached to it about an axis or axes corresponding to one or more of said straight pipe sections.

The bending may be made in several ways, using bending machines or utensils, dies, or other deforming tools.

In carrying out the invention it may be arranged that said flat serpentine configuration and the wires attached to it are bent about axes corresponding to alternate ones of said straight sections, and it is preferably arranged that the wires attached to opposite sides of the flat serpentine configuration are staggered one with respect to the other.

By arranging that the flat serpentine configuration is bent about an axis or axes corresponding to one or more of the straight pipe sections means that the pipe is subjected only to a torsion substantially around its own axis, and not to a bending along a transversal axis which normally leads to a weakening of the serpentine and to the reduction of the cross section of the pipe due to throttling of the pipe at the bending points.

The particularly choice of the position of the lines of bending and the staggered wires allows the bending of the exchanger from the flat configuration into the one showing at least some inclined sections avoiding any risk of tearing away the wires from the serpentine, i.e. breaking the point of soldering.

The above mentioned advantages are particularly relevant in the case of a zigzag profiled exchanger, in which there are different bending lines.

The invention refers also to a heat exchanger of the kind mentioned which comprises a pipe bent into a serpentine configuration consisting of a series of substantially parallel straight pipe sections, a plurality of wires attached to each side of the serpentine configuration, said wires extending along the length of the serpentine configuration and being attached to said straight pipe sections thereof, and characterised in that the serpentine configuration and the wires attached to it are bent about an axis or axes corresponding to one or more of said straight pipe sections.

Conveniently, it may be arranged that the serpentine configuration and the wires attached to it are bent about axes corresponding to alternate ones of said straight pipe sections, or alternatively it may be arranged that said serpentine configuration and the wires attached to it are bent about axes corresponding to different ones of said straight pipe sections to afford a zigzag profile, a saw tooth profile or an irregular profile.

Preferably, the wires attached to opposite sides of the serpentine configuration are staggered one with respect to the other.

The characteristic features of the invention and the advantages due to them will appear more clearly from the following description of a preferred embodiment which is illustrated in the annexed drawings, in which.

Figure 1:
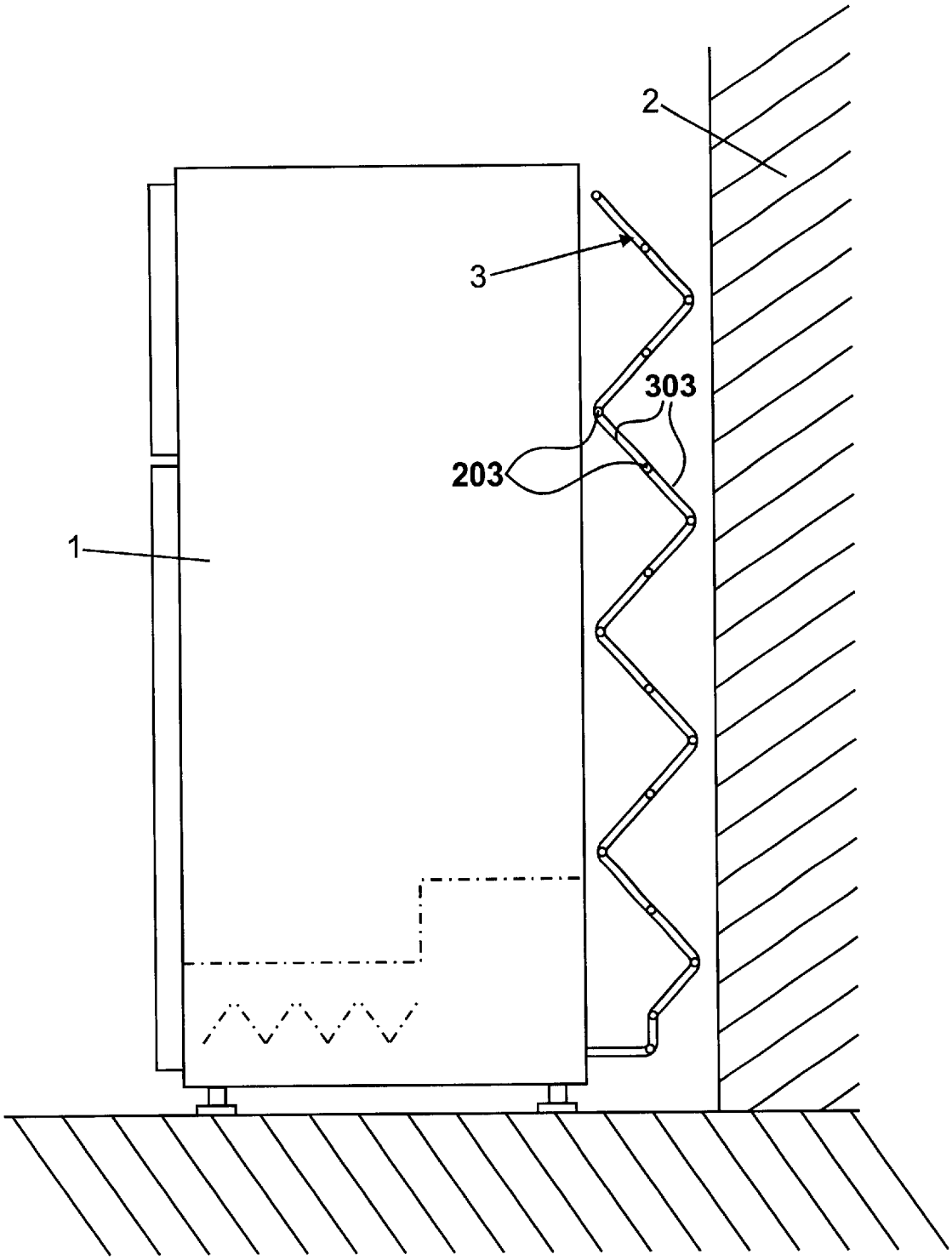
FIG. 1 shows a refrigerator having a condenser with a regular zigzag profile according to the present invention.

With reference to FIG. 1, a refrigerator 1 is positioned with its rear against a wall 2 of a room. The serpentine condenser of the refrigerating circuit is fitted externally to the rear face of the same refrigerator 1. Between the rear face of the same refrigerator 1 and the wall 2 of the room, a space may be left with a specified minimum distance, for the purpose of forming a kind of vertical conduit, in which will be generated a spontaneous rising flow of air which sweeps past and cools the condenser.

The condenser 3 which is a serpentine heat exchanger shows a zigzag profile when seen in the lateral elevation, i.e.

from the side. The profile is a serrated one with triangular teeth which are isosceles and all the same, but which may also be irregular and differing between themselves.

Figure 2:
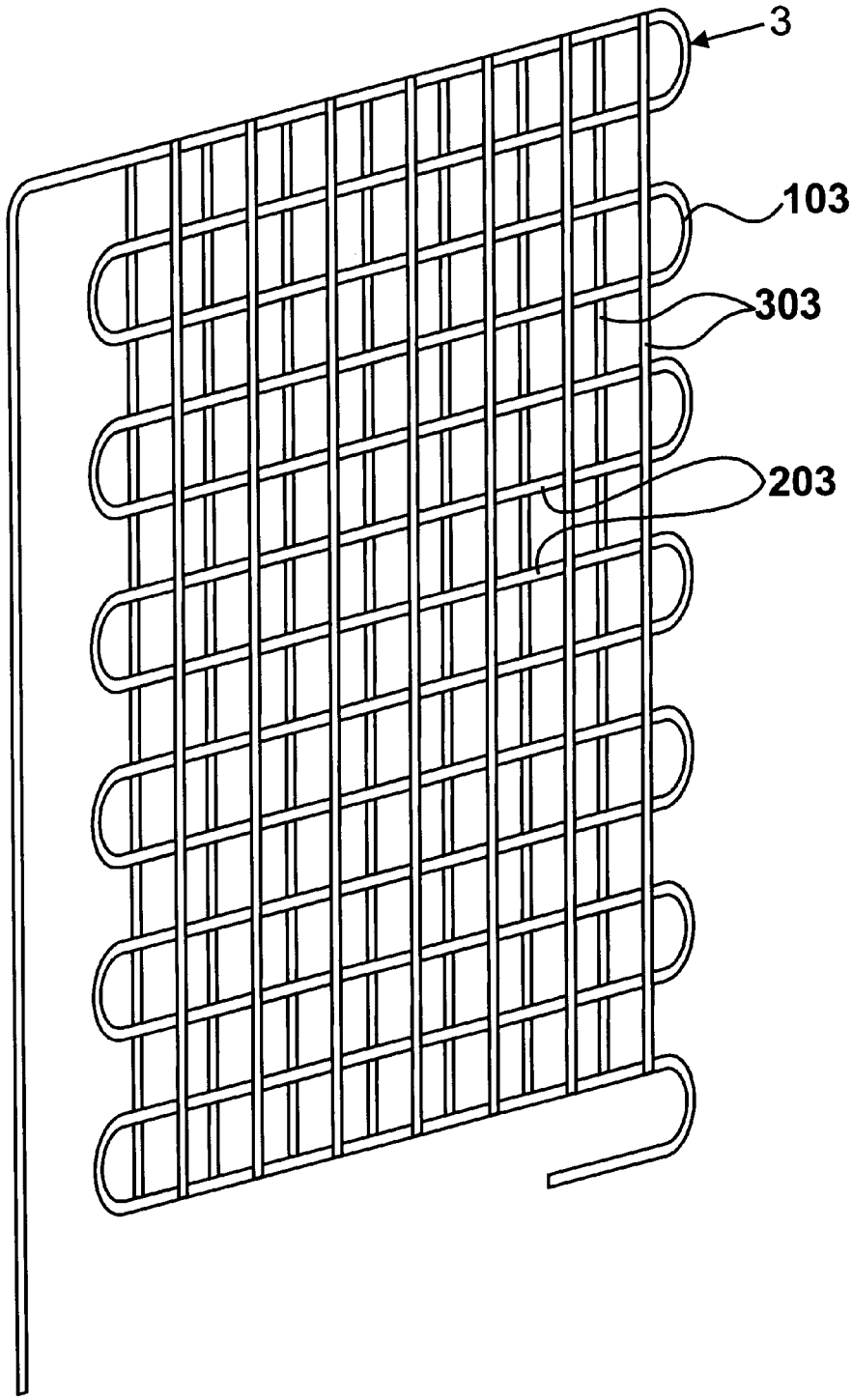
FIG. 2 shows a perspective view of a flat condenser built in the first step of the method according to the invention.
Figure 3:
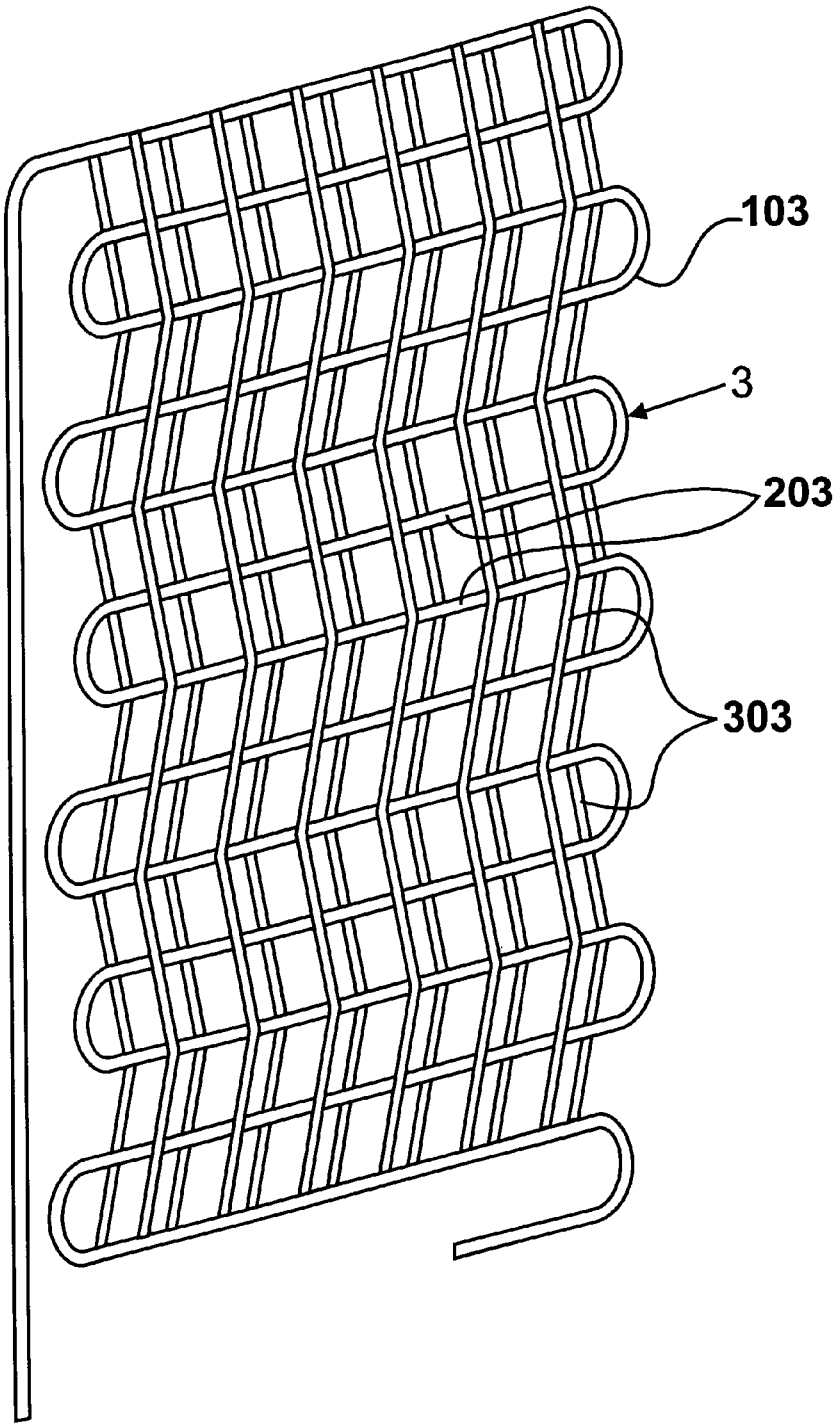
FIG. 3 shows a perspective view of a condenser bent in such a way to show a zigzag profile in the second step of the method according to the invention.

FIGS. 2 and 3 illustrates the two steps of the method for building such an exchanger.

In the first step (FIG. 2), the condenser or exchanger is built as a usual flat one. So it is possible to use the same lines of production of usual exchanger or condenser.

The second step concerns the bending, moulding, or deforming the flat exchanger 3 in the definitive zigzag profiled one.

In order to bend, mould, or deform the flat exchanger to the bent, in the case of FIGS. 1 to 3, zigzag configuration, it is possible to use any kind of means, like bending devices, moulds, or other kinds of deforming devices.

As FIGS. 2 and 3 clearly show, preferably the serpentine 103 of the exchanger 3 is oriented in such a way that the parallel sections 203 of the pipe are oriented transversally to the direction of the air flow passing through the exchanger, particularly substantially parallel to the lines of bending.

Preferably, the lines of bending are chosen in the vicinity of the parallel sections 203 of the serpentine pipe. Particularly, the bending lines can be chosen also perfectly coaxial with the corresponding sections 203 of the serpentine pipe 103.

In this case the serpentine pipe is not submitted to a bending which is transversal to its axis and which can lead to a weakening of the serpentine and to the throttling of the pipe in the zone of bending.

The serpentine pipe is submitted to a torsion substantially around its axis, and this kind of deformation eliminates the danger of any throttling.

As it results also from FIG. 2, the wires 303 which are fitted on both of the opposite sides of the serpentine are positioned staggered the ones of one side with respect to the other on the opposite side.

This feature avoids any interference of the wires 303 with one another during bending of the exchanger 3 from its flat configuration to the bent one.

The angle of bending the inclined sections depends on the different materials and on the kind of structure of the exchanger and may be calculated.

Figure 4:
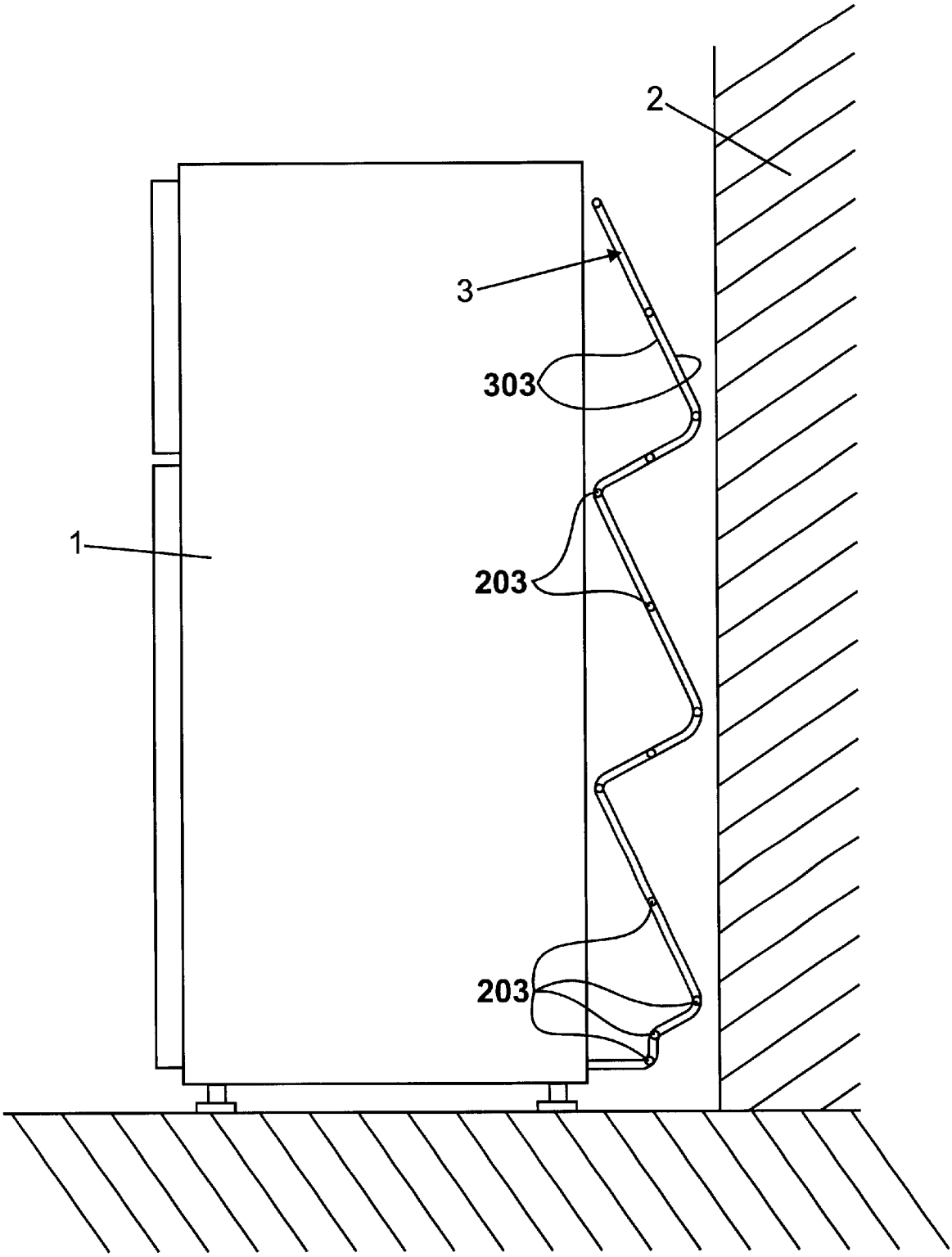
FIG. 4 shows a refrigerator having a condenser with saw tooth profile.
Figure 5:
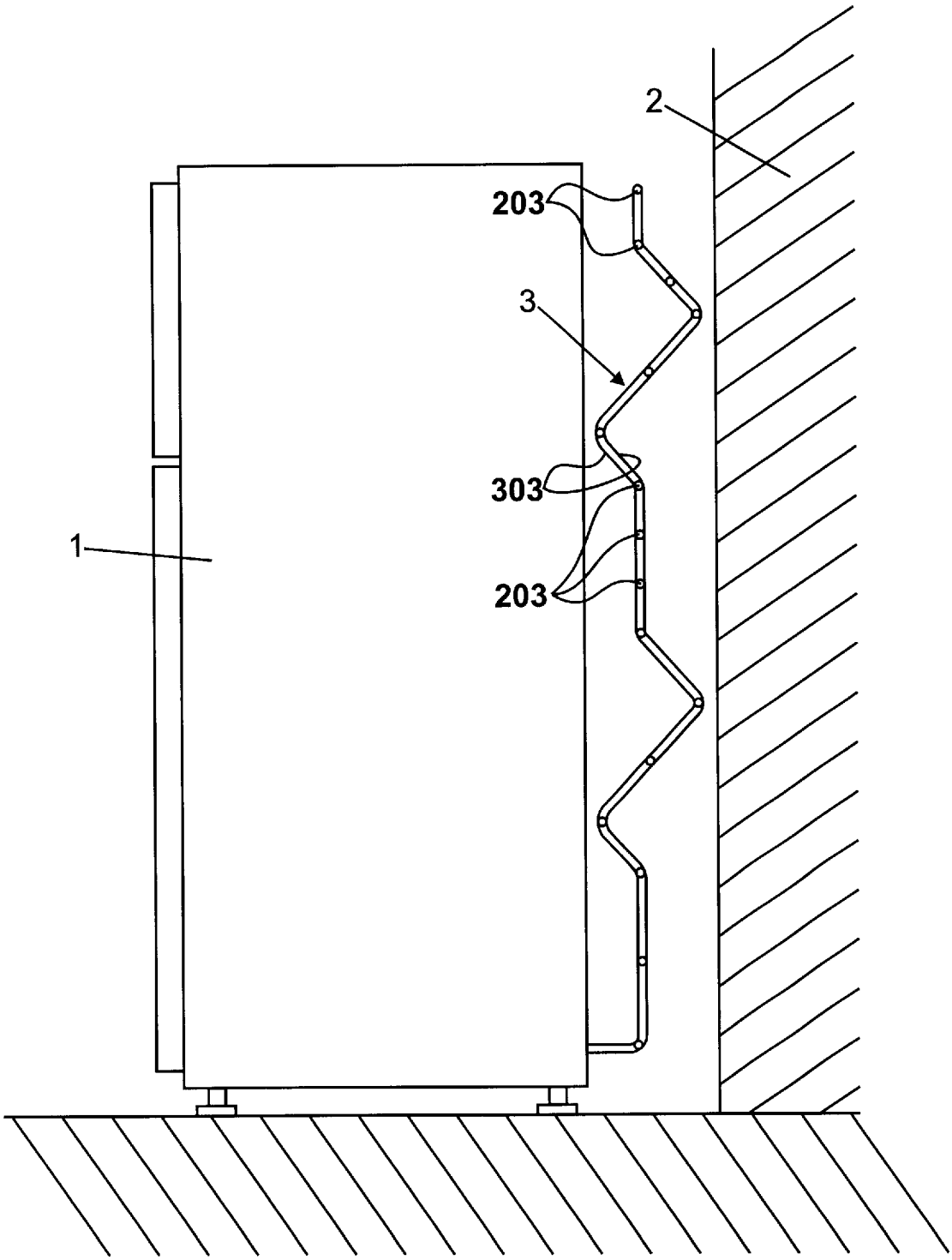
FIG. 5 shows a refrigerator having a condenser with a irregular broken-line profile.

According to FIGS. 4 and 5, the configuration of the exchanger which may be obtained with the method according to the present invention is not limited to a regular zigzag profile.

Depending on the distances between the sections 203 of the serpentine pipe 103 which are parallel to the bending lines, it is also possible to construct exchangers having a saw tooth profile or a profile according to an irregular shaped broken line.

In the last case it is also possible to construct a serpentine having different distances between two adjacent serpentine pipe sections 203. This allows to obtain a very large number of different irregular or combined configurations.

In the examples shown in the figures, the lines of bending and the coinciding sections 203 of the serpentine pipe 103 are oriented transversally to the direction of the flow of air passing through the exchanger 3.

What is claimed is:

1. A method for building a serpentine heat exchanger (3) being profiled in such a way to present from a lateral side view and relative to at least one part of its length an inclination the direction of which is suddenly or progressively inverted at least once relative to a plane which is substantially parallel to the general plane of the heat exchanger (3), said method characterised by the sequential steps of (a) bending a pipe into a flat serpentine configuration (103) consisting of a series of substantially parallel straight pipe sections (203), (b) attaching a plurality of wires (303) to each side of the flat serpentine configuration (103), said wires (303) extending along the length of the flat serpentine configuration (103) and being attached to said straight pipe sections (203) thereof, and (c) bending the flat serpentine configuration (103) and the wires (303) attached to it about an axis or axes corresponding to one or more of said straight pipe sections (203).

2. A method according to claim 1, in which said flat serpentine configuration (103) and the wires (303) attached to it are bent about axes corresponding to alternate ones of said straight pipe sections (203).

3. A method according to claim 1, in which the wires (303) attached to opposite sides of the flat serpentine configuration (103) are staggered one with respect to the other.

4. A method according to claim 1, in which said serpentine heat exchanger is a condenser for refrigerating circuits.

* * * * *

UNITED STATES PATENT AND TRADEMARK OFFICE

CERTIFICATE OF CORRECTION

PATENT NO. : 6,389,695 B1
APPLICATION NO. : 09/068526
DATED : May 21, 2002
INVENTOR(S) : Dall'Oro et al.

It is certified that error appears in the above-identified patent and that said Letters Patent is hereby corrected as shown below:

On the title page,
Item [*] delete "0" and insert --472--.

Signed and Sealed this

Twenty-seventh Day of February, 2007

JON W. DUDAS
*Director of the United States Patent and Trademark Office*